US008011375B2

(12) United States Patent
Defenbaugh et al.

(10) Patent No.: US 8,011,375 B2
(45) Date of Patent: Sep. 6, 2011

(54) UNITARY HAIR CLIP AND METHOD OF USE

(75) Inventors: Michael Defenbaugh, Marietta, GA (US); Regina Hopper, Sylvania, GA (US); Allison Hardin, Smyrna, GA (US)

(73) Assignee: Goody Products, Inc., Atlanta, GA (US)

( * ) Notice: Subject to any disclaimer, the term of this patent is extended or adjusted under 35 U.S.C. 154(b) by 317 days.

(21) Appl. No.: 11/833,537

(22) Filed: Aug. 3, 2007

(65) Prior Publication Data

US 2009/0032047 A1 Feb. 5, 2009

(51) Int. Cl.
*A45D 8/00* (2006.01)
*A45D 8/24* (2006.01)

(52) U.S. Cl. ..... 132/273; 132/277

(58) Field of Classification Search ..... 132/273–278, 132/279, 280–284, 245–248; D28/39–42
See application file for complete search history.

(56) References Cited

U.S. PATENT DOCUMENTS

| | | | | |
|---|---|---|---|---|
| 756,838 | A * | 4/1904 | Drees | 132/248 |
| 1,316,981 | A * | 9/1919 | Singer | 132/278 |
| 2,935,071 | A * | 5/1960 | Waggener | 132/278 |
| 3,250,282 | A * | 5/1966 | Thatcher | 132/277 |
| 3,673,640 | A * | 7/1972 | Brown | 24/30.5 R |
| 4,953,266 | A | 9/1990 | Trinkaus | 24/499 |
| 5,044,050 | A | 9/1991 | Trinkaus | 24/499 |
| 5,566,690 | A | 10/1996 | Shih-Ming | |
| D393,928 | S * | 4/1998 | Chou | D28/42 |
| 5,775,345 | A * | 7/1998 | Chou | 132/278 |
| 5,957,141 | A | 9/1999 | Elkins | |
| D429,031 | S | 8/2000 | Tsai | D28/40 |
| 6,142,159 | A | 11/2000 | Lloyd | 132/278 |
| 6,305,387 | B1 | 10/2001 | Atchison | |
| 6,681,778 | B1 | 1/2004 | Salisbury et al. | 132/277 |
| 6,981,507 | B2 | 1/2006 | Gabriele-Baumann | 132/275 |
| D536,132 | S | 1/2007 | Vergona | D28/40 |
| 7,174,899 | B2 | 2/2007 | Lane | 132/273 |
| 7,373,940 | B1 * | 5/2008 | Lloyd | 132/278 |
| 2002/0162564 | A1 | 11/2002 | Head et al. | |
| 2004/0007243 | A1 | 1/2004 | Paterson | |
| 2004/0226574 | A1 | 11/2004 | Winn et al. | 132/277 |
| 2004/0231692 | A1 | 11/2004 | Shyu | 132/277 |
| 2005/0109362 | A1 | 5/2005 | La Fauci | 132/276 |
| 2006/0021631 | A1 | 2/2006 | Lafauci | |
| 2006/0124149 | A1 | 6/2006 | Salisbury et al. | 132/277 |
| 2006/0225763 | A1 | 10/2006 | Lau | 132/277 |
| 2007/0131238 | A1 | 6/2007 | Chudzik et al. | |

FOREIGN PATENT DOCUMENTS

GB 2215202 A * 9/1989

OTHER PUBLICATIONS

International Search Report and Written Opinion of the International Searching Authority for PCT/US2008/071686; date of mailing Oct. 22, 2008; 11 pages.

* cited by examiner

*Primary Examiner* — Robyn Doan
(74) *Attorney, Agent, or Firm* — Lempia Summerfield Katz LLC

(57) ABSTRACT

This invention provides a unitary hair clip. More specifically, provided is an elastic midsection with a first portion extending from the midsection, the first portion having a first width. A second portion extends from the midsection opposite from the first portion. The second portion provides an aperture having a second width greater than the first width. The aperture is adapted to receive the first portion. The first portion, the second portion and the elastic midsection are formed as a contiguous seamless structure.

17 Claims, 5 Drawing Sheets

UNITARY HAIR CLIP AND METHOD OF USE

FIELD

This invention relates generally to the field of hair clips and, in particular, to a unitary hair clip and method of use.

BACKGROUND

Hair clips are widely used devices to retain the hair of a wearer towards the back of the head. Traditional clips such as claw clips and the like, have a tendency to catch hair in the exposed coil spring and or hinge. As traditional hair clips are typically manufactured in such a way as to combine multiple separate and distinct parts, in addition to the spring and the hinge, there may be other structural elements that can potentially capture hair as well.

When the spring, hinge or other elements entrap hair, the caught hair is frequently pulled out of the wearer's head upon removal of the hair clip, a potentially painful and unpleasant experience for the wearer of the hair clip. Even if the hair is not pulled out, the caught hair may be cut, crimped or otherwise damaged. Such cutting, crimping or other damage can cause the hair to lie at an odd angle relative to the rest of the un-damaged hair and therefore be unsightly.

In addition, as hair clips are generally composed of these multiple elements snapped or otherwise fit together, so as to maintain the proper alignment for interconnection, the hair clips typically are formed of hard plastic and metal, which results in rigid elements. As the wearer of a hair clip is often likely to be in a situation where his or her head is likely to contact a supporting surface, such as a head rest in a car, bus, plane, or other vehicle, the rigid structures can be quite painful to the wearer when the hair clip is itself caught between the wearer's head and a supporting surface.

The opportunity for discomfort when the hair clip is caught between the wearer's head and a supporting surface is further heightened by the fact that hair clips, such as claws, do not conform to the wearer's head. Barrettes generally do have a curved profile in an attempt to conform to the wearer's head, but as with claw clips, barrettes have exposed springs and hinge elements that frequently trap and/or damage hair. In addition, the metal and hard plastic elements of barrettes make them generally uncomfortable as well when caught between a wearer's head and a supporting surface.

Although some attempts have been made to cover the spring and hinge of a claw clip, these devices still maintain the rigid structures that may be painfully pressed into the wearer's head. The spring and hinge coverings may also be bulky and displeasing.

Hence, there is a need for a hair clip and method of using a hair clip that overcomes one or more of the drawbacks identified above.

SUMMARY

This invention provides a unitary hair clip and associated method of use.

In particular, and by way of example only, according to an embodiment, provided is a unitary hair clip, including: an elastic midsection; a first portion extending from the midsection, the first portion having a first width; and a second portion extending from the midsection opposite from the first portion, the second portion providing an aperture having a second width greater than the first width, and adapted to receive the first portion, the first portion, the second portion and the elastic midsection comprise a contiguous seamless structure.

In yet another embodiment, provided is a method of temporarily binding hair with a hair clip provided by a continuous strip of flexible material having a top surface, a bottom surface and a longitudinal centerline. The hair clip further provides a first portion with a first distal end extending along the longitudinal centerline from a midsection. The first portion has a width. A second portion with a second distal end extends along the longitudinal centerline from the midsection opposite from the first portion. The second portion provides an aperture disposed symmetrically about the longitudinal centerline and between the midsection and the second distal end. The aperture has a width that is greater than the first width and a length greater than the second width. The hair is temporarily bound by bending the first portion about the midsection towards the second portion. The bend is accentuated to place the first distal end through the aperture. The bend is then released to extend the first distal end through the aperture, the release of the bend further bringing the first surface of the first distal end into pressured contact with the first surface proximate to the second distal end. This pressured contact achieves a frictional force of sufficient magnitude to hold the first distal end against the second distal end. The hair clip is opened by depressing the first portion through the aperture to bend the first portion about the midsection and separate the first distal end from the second distal end. The bend is accentuated to place the first distal end within the aperture. The first distal end is then withdrawn from the aperture and the first portion is released.

DETAILED DESCRIPTION

Before proceeding with the detailed description, it is to be appreciated that the present teaching is by way of example, not by limitation. The concepts herein are not limited to use or application with a specific unitary hair clip and method of use. Thus, although the instrumentalities described herein are, for the convenience of explanation, shown and described with respect to exemplary embodiments, it will be appreciated that the principles herein may be equally applied in other types of unitary hair clips and/or methods of using a unitary hair clip.

Figure 1:
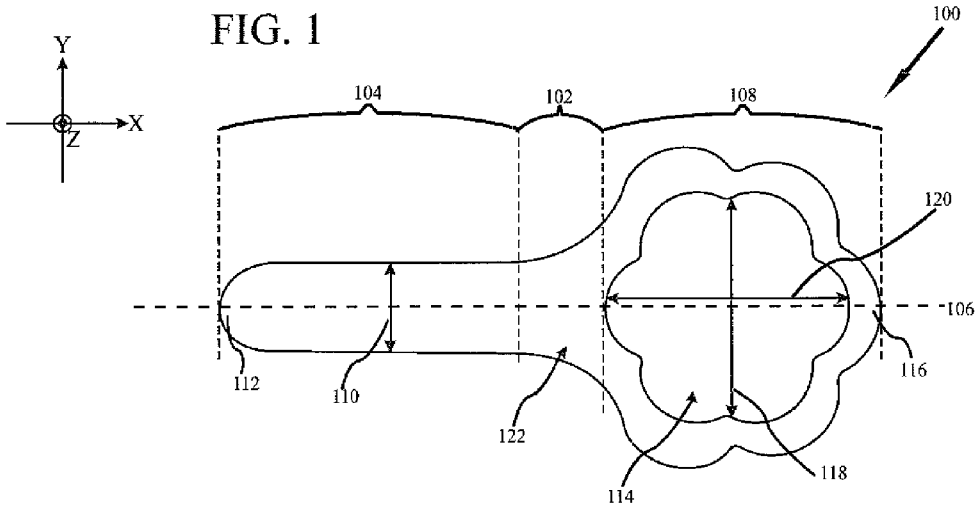
FIG. 1 is a plane view of a unitary hair clip in accordance with at least one embodiment.

Turning now to the figures, and more specifically FIG. 1, there is shown a unitary hair clip 100 in accordance with at least one embodiment. To facilitate the description, the orientations are referenced to the coordinate system with three axes orthogonal to one another, as shown in FIG. 1. The axes intersect mutually at the origin of the coordinate system which is intended to be the center of the unitary hair clip 100. The axes shown in all figures are offset from their actual locations for clarity of illustration. Moreover, FIG. 1 is understood to be a plane view of the unitary hair clip 100 upon the YX plane.

As shown in FIG. 1, unitary hair clip 100 has an elastic midsection 102, a first portion 104 extending from the midsection 102 generally along a longitudinal centerline 106, and a second portion 108 extending from the midsection 102 generally along the longitudinal centerline 106 opposite from the first portion 104. The first portion 104 has a first width 110 and a first distal end 112. The second portion 108 provides an aperture 114 and a second distal end 116. The aperture 114 has second width 118 that is greater than the first width 110. The aperture 114 has a length 120 that is also greater than the first width 110. In addition, the aperture 114 is adapted to receive the first portion 104.

As is further illustrated in the accompanying figures, it is appreciated that unitary hair clip 100 is provided by a continuous strip 122 of flexible material. Moreover, in at least one embodiment the first portion 104, the second portion 108 and the midsection 102 comprise a contiguous unitary structure. In at least one embodiment this continuous strip 122 of flexible material is selected from the group consisting of plastic, natural rubber, polyurethane, resin and or combinations thereof. In at least one embodiment the flexible material is 60 derometer TPE.

Unitary hair clip 100 is understood and appreciated to be a structure that is substantially seamless and free of seams, joints, or other structure that might unintentionally entrap and/or damage a user's hair.

The dimensions of the unitary hair clip 100 may vary so as to provide appropriate sized clips for children and adults. More specifically, in at least one embodiment, the first portion 104 has a length dimension of between about two to three inches and the second portion 108 has a length dimension of between about two to three inches The first width 110 is between about one-half inch to one inch and is substantially uniform and continuous from the first distal end 112 to the midsection 102. The aperture 114 has a second width 118 of between about one-and-a-half inches to three inches and a length 120 of between about one-and-a-half inches to three inches.

Figure 2:
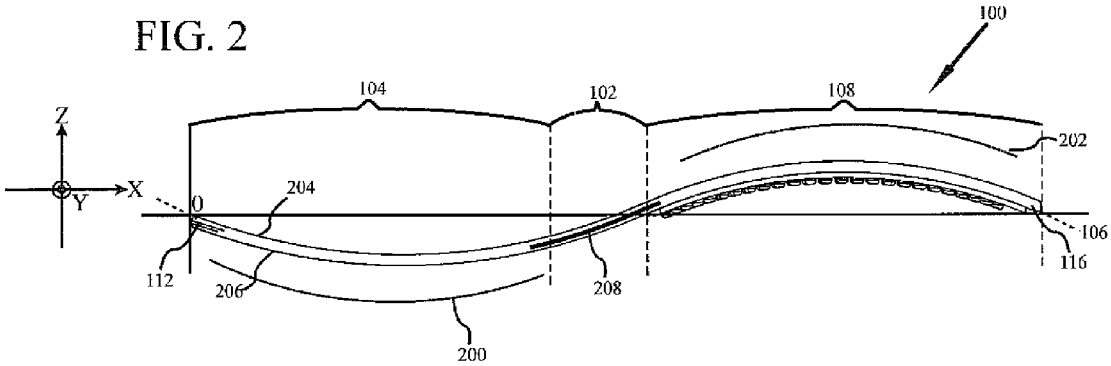
FIG. 2 is a side view of a unitary hair clip in accordance with at least one embodiment.

FIG. 2 is a side view of the unitary hair clip 100 upon the ZX plane. With respect to FIG. 2, in at least one embodiment the first portion 104 conforms to a first curve 200 from the first distal end 112 to the midsection 102. The second portion 108 conforms to a second curve 202 from the midsection 102 to the second distal end 116, the second curve 202 substantially an inversion of the first curve 200. The first curve 200 and the second curve 202 are selected such that in the closed position, described further below, the unitary hair clip 100 has a generally concave contour selected to conform generally to a human head.

Moreover, in at least one embodiment, the unitary hair clip 100 has an initial state conforming generally to a sinusoidal wave, the first distal end 112 of the first portion defining the start of the sinusoidal wave, the midsection 102 defining the middle of the sinusoidal wave, and the second distal end 116 of the second portion 108 defining the end of the sinusoidal wave. Indeed, in at least one embodiment, the unitary hair clip 100 has an initial state where the longitudinal centerline 106 when viewed from the side conforms generally to an "S" shape.

As is also shown most clearly in FIG. 2, unitary hair clip 100 has a first surface 204 and opposite thereto, a second surface 206. The thickness of unitary hair clip 100 as between the first surface 204 and the second surface 206 is generally consistent over the entire length of the unitary hair clip 100. In at least one embodiment, the unitary hair clip 100 is formed through a process that provides a spring element 208 embedded internally within the midsection 102. In at least one embodiment, the embedded spring element 208 is a plastic spring element.

Figure 3:
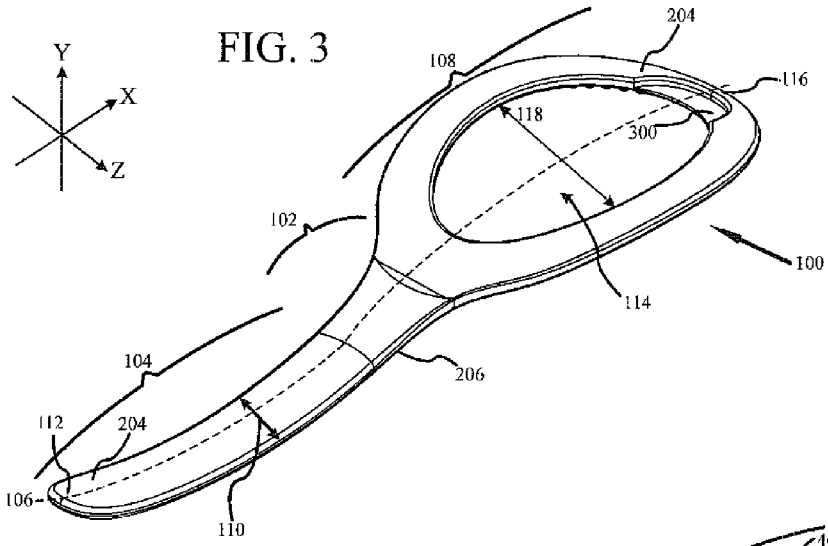
FIG. 3 is a perspective view of a the first surface of a unitary hair clip in accordance with at least one embodiment.
Figure 4:
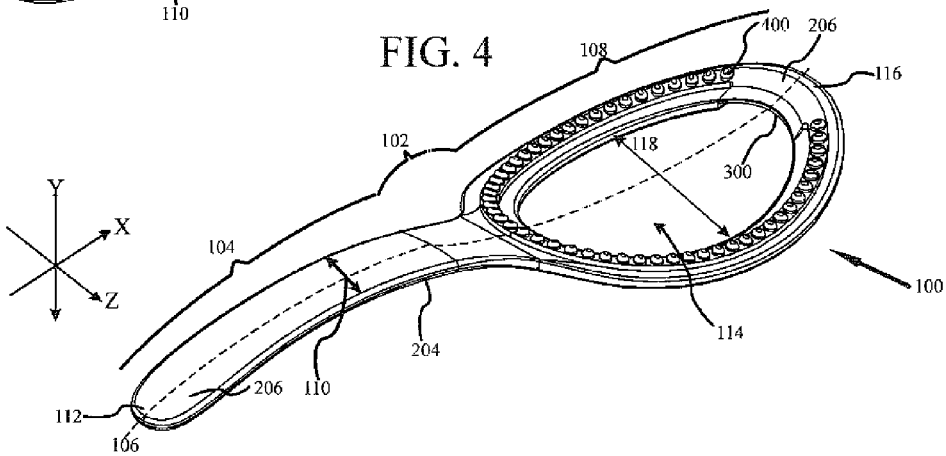
FIG. 4 is a perspective view of a the second surface of a unitary hair clip in accordance with at least one embodiment.

FIGS. 3 and 4 provide top and bottom perspective views of unitary hair clip 100. As shown, the aperture 114 in FIGS. 3 and 4 is geometrically different from the aperture 14 shown in FIG. 1. It is understood and appreciated that the geometric shape of the aperture may take many forms, including but not limited to, flower, oval, or rectangle. Generally, the geometric shape of the aperture is selected to provide rounded sides and edges so as not to pinch or crimp the hair of a user In addition, in at least one embodiment the aperture 114 is disposed symmetrically about the longitudinal centerline 106. Further still, in at least one embodiment the second portion of the hair clip is formed by a peripheral loop element that defines the aperture 114, the aperture is disposed symmetrically about the longitudinal centerline 106, and the peripheral loop element is formed by two lateral loop segments extending between the second distal end 116 and the midsection 102 with the lateral loop segments tapering laterally out wider from the midsection and tapering laterally back in and meeting at the second distal end.

As FIG. 3 is a perspective view generally of the first surface 204, it can be appreciated that in at least one embodiment, at the second distal end 116 a receiver 300 structured and arranged to receive at least a portion of the first distal end 112, and more specifically in at least one embodiment a portion of the first surface 204 of the first distal end 112. As shown, in at least one embodiment, the receiver 300 is a notch appropriately sized and shaped to receive a portion of the first distal end 112.

FIG. 4 is a perspective view generally of the second surface 206. As is shown in FIG. 4 most clearly, the unitary hair clip 100 may have a plurality of raised nubs 400 disposed about the aperture 114. In at least one embodiment the raised nubs 400 are disposed substantially about the entire perimeter of the aperture 114 as shown. In at least one alternative embodiment, the raised nubs 400 are disposed in one or more groups and provided in specific locations proximate to the aperture 114. Although raised nubs 400 are shown as symmetrical half-sphere like structures for ease of illustration and discussion, it is understood and appreciated that the raised nubs may be ridges as well as provided in varying three dimensional geometrical forms.

Further still, in at least one embodiment, one or more raised nubs (not shown) are provided upon the first portion 104. When closed, the raised nubs of the first portion and the raised nubs 400 about the aperture, cooperatively grip the user's hair from multiple sides and enhance the hair holding property of the unitary hair clip 100.

In at least one embodiment, the raised nubs 400 are formed of the same flexible material forming the continuous strip 122 of unitary hair clip 100. In an alternative embodiment, the raised nubs 400 may be formed of a separate, hair tacky material that is integrated into the continuous strip 122. Moreover, in a specific embodiment, the unitary hair clip 100 is formed from nylon 6,6 with a 60-70 durometer TPE overmold in the area proximate to the aperture 114.

In yet another embodiment, the raised nubs may be coated with a hair tacky material, such as TPE. It is understood and appreciated that the overmolding or coating is performed so as to avoid the generation of a hair catching edge or seam between the hair tacky material and the underlying material forming the continuous strip 122.

Figure 5:
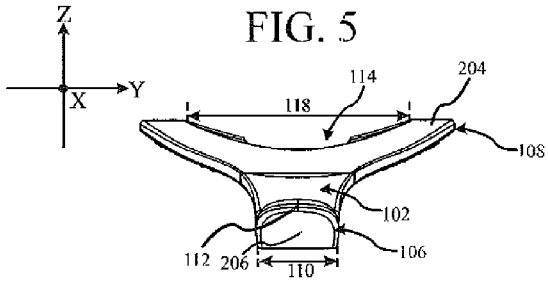
FIG. 5 is an end view of the unitary hair clip in accordance with at least one embodiment.

FIG. 5 illustrates an end view of unitary hair clip 100 upon the ZY plane from the vantage point of the first distal end 112. With respect to FIG. 5, the relative difference in dimensional length of the first width 110 of the first portion 104 and the second width 118 of the aperture 114 is further appreciated.

FIGS. 1-5 show an initial open state of unitary hair clip 100. With respect to these figures, it is understood and appreciated that unitary hair clip 100 is a generally smooth hair friendly structure that does not have springs, seams, hinges or other structures that might crimp, bind, cut or otherwise damage a user's hair. So as to contain and hold a user's hair, the unitary hair clip 100 is operable to move from an open state to a closed state.

Figure 6:
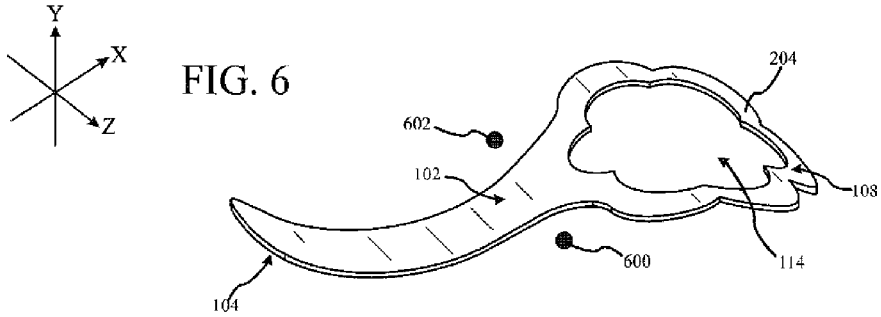
FIGS. 6-9 illustrate a method of operating the unitary hair clip from an initial open position to a closed position in accordance with at least one embodiment.

FIGS. 6~9 illustrates the process of closing the unitary hair clip 100. More specifically, from an initial open state as shown in FIG. 6, the first portion 104 is torqued about the midsection 102 towards the second portion 108, see FIG. 7. For purposes of illustration, imaginary point 600 is shown as general point about which first portion 104 is rotated. As the rotation is continued, the first distal end is passed through the aperture 114, as indicated by arrow 800. In at least one embodiment, the user passes the first distal end 112 thorough the aperture 114 by accentuating the bend of the first portion 104, by applying force 802 to the first portion 104 proximate to the first distal end 112, see FIG. 8.

When the first distal end 112 has been passed through the aperture 114, the bend is released (indicated by arrow 900) to extend the first distal end 112 through the aperture and towards the second distal end 116, indicated by arrows 902. The release of the bend brings the first surface 204 of the first distal end 112 into pressured contact with the first surface 204 of the second distal end 116, see FIG. 9. The pressured contact achieves a frictional force of sufficient magnitude to hold the first distal end 112 against the second distal end 116. In other words, the first distal end 112 binds against the second distal end 116 to maintain the unitary hair clip 100 in a closed position.

Figure 10:
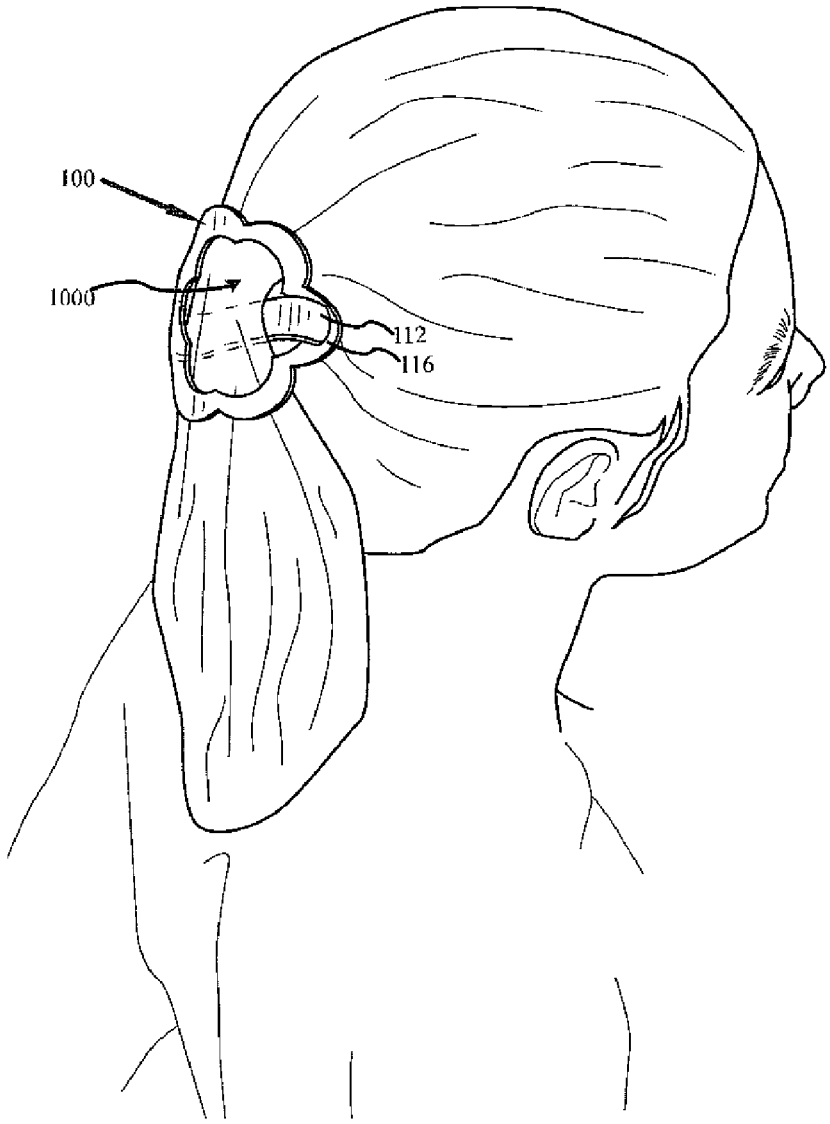
FIG. 10 illustrates the closed unitary hair clip in use, temporarily binding hair in accordance with at least one embodiment.

FIG. 10 is a perspective view of the unitary hair clip 100 closed and engaged about a wearer's hair 1000. As shown in this closed configuration, unitary hair clip 100 is further appreciated to have a generally concave contour that generally conforms to the human head. It is understood and appreciated that a locking clasp, snapping clip, or other engaging device is advantageously not employed to maintain the unitary hair clip 100 in a closed position.

The absence of such a locking mechanism or device eliminates the opportunity to damage a user's hair. Indeed, the user's hair may be between the first surface 204 of the first distal end 112 and the first surface 204 of the second distal end 116 without crimping or cutting damage being imposed upon the hair, and the unitary hair clip 100 will remain closed. In addition, in many instances the wearing user may bring his or her head against a surface proximate to if not directly upon the area of the head where the unitary hair clip 100 has been placed to temporarily bind the hair. As unitary hair clip 100 is entirely flexible, unitary hair clip 100 may distort under pressure and indeed the first distal end 112 may slide against the second distal end 116 without breaking or opening.

From the closed state, the unitary hair clip 100 is opened by reversing the closing process. More specifically, the first portion 104 is depressed through the aperture 114 to bend the first portion 104 about the midsection 102 and separate the first distal end 112 from the second distal end 116. The bend is accentuated to place the first distal end 112 within the aperture 114. The first distal end 112 is then withdrawn from the aperture 114 and the first portion 104 is released.

Moreover, the elastic midsection 102, if not the entire continuous strip 122 is formed to have a have an initial state wherein the first distal end 112 and the second distal end 116 are biased to be separated. The elastic midsection 102 and the entire continuous strip 122 is also flexible, such that it may be bent and/or otherwise contorted, but when released is biased to return to it's initial state of configuration. When the first portion 104 is passed through the aperture 114 of the second portion 108, an expansive spring force is imposed as the unitary hair clip attempts to return to it's initial biased state. In at least one embodiment an internal spring element 208 is provided within the midsection to enhance the spring force which maintains the unitary hair clip Whereas FIGS. 1-5 illustrate an initial open state of unitary hair clip 100 in accordance with at least one embodiment wherein the longitudinal centerline 106 conforms generally to an "S" shape, in an alternative embodiment longitudinal centerline 106 in the initial open state conforms generally to a "U" shape. In adopting a "U" shape the first portion 104 and the second portion 108 are oriented generally in the same direction as is suggested by FIG. 6.

As shown and described above with respect to FIG. 3, in at least one embodiment the second end 112 may provide a receiver 300, such as the illustrated notch. The first surface 204 of the receiver 300 and the first surface of the distal end may be coated with or partially formed with a flexible material having a high frictional coefficient to enhance the frictional binding of the first distal end 112 against the second distal end 116 when the unitary hair clip 100 is closed.

Figure 7:
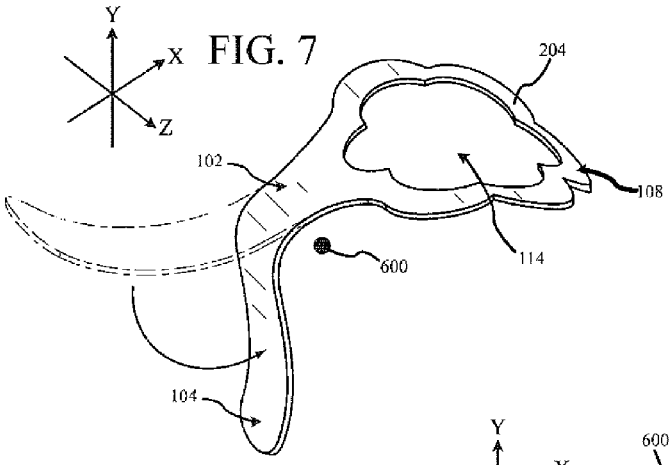
Figure 8:
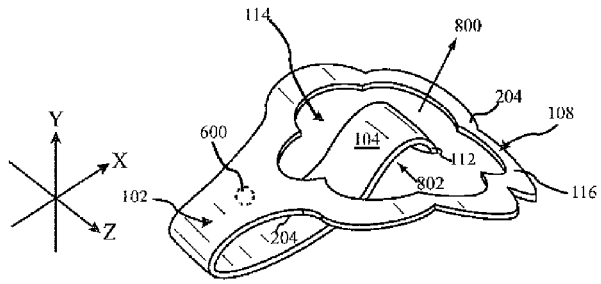
Figure 9:
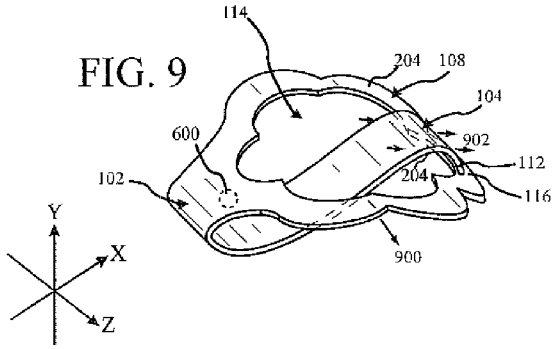

With respect to FIGS. 6-8, the unitary hair clip 100 is illustrated as being closed about imaginary point 600, such that the first surface 204 of the first distal end 112 is brought into frictional contact with the first surface 204 of the second distal end 116. It is understood and appreciated that in at least one alternative embodiment the unitary hair clip 100 is closed by rotating the first portion 104 about imaginary point 602 such that the second surface 206 of the first distal end 112 is brought into contact with the second surface 206 of the second distal end 116.

Figure 11:
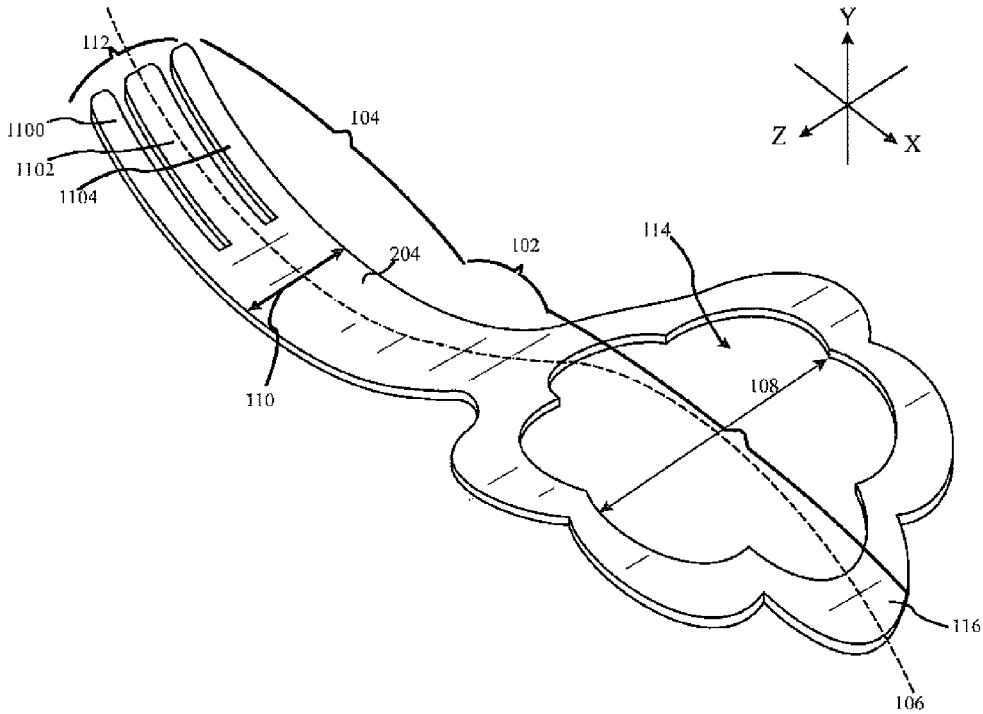
FIG. 11 is a perspective view of yet another alternative embodiment of a unitary hair clip.

In addition to the embodiments shown and described above, FIG. 11 illustrates a perspective view of yet another alternative embodiment of unitary hair clip 100. More specifically, as shown the first portion 104 is subdivided into a plurality of parallel members, such as members 1100, 1102, 1104. In such an embodiment, the plurality of parallel members operate collectively as the first portion 104 described and illustrated above.

Changes may be made in the above methods, systems, processes and structures without departing from the scope hereof. It should thus be noted that the matter contained in the above description and/or shown in the accompanying drawings should be interpreted as illustrative and not in a limiting sense. The following claims are intended to cover all generic and specific features described herein, as well as all statements of the scope of the present method, system and structure, which, as a matter of language, might be said to fall therebetween.

What is claimed is:

1. A unitary hair clip for binding a bundle of hair, comprising:

a continuous unitary strip of flexible material having a first surface, a second surface opposite thereto, and a longitudinal centerline, the strip comprising:

an elastic midsection;

a first elongate strip portion with a first distal end extending along the longitudinal centerline from the elastic midsection, the first portion having a first width; and a second loop portion with a second distal end extending along the longitudinal centerline from the elastic midsection opposite to the first portion, the second loop portion including a peripheral loop element formed by two lateral loop segments tapering laterally out wider from the elastic midsection, tapering laterally back in and meeting at the second distal end, and defining an aperture that is disposed about the longitudinal centerline and between the elastic midsection and the second distal end, the aperture having a second width that is greater than the first width of the first strip portion, wherein the strip is movable between the initial open position and an in-use closed position, the elastic midsection biases the strip toward the open position and against the movement to the closed position, in the open position the first and second portions are separated so that the hair bundle can be inserted therebetween, and in the closed position the first and second portions are coupled together so that the hair bundle is gripped therebetween, wherein in the closed position the first portion is disposed through the aperture with the elastic midsection providing an expansive force binding the first distal end back against the second distal end to maintain the contiguous structure in the closed position, wherein in the open position the first portion and the second portion extend in generally opposite directions away from the elastic midsection, and in the closed position the first portion is bent and torqued about the elastic midsection and passed through the aperture of the second portion with the first surface of the first distal end binding against the first surface of the second distal end to maintain the strip in the closed position, and wherein in the closed position the hair bundle is routed under and against the second surface of one of the lateral loop segments of the second portion peripheral loop element, and at least partially out through the second portion aperture, over and against the second surface of the first portion, back through the second portion aperture, and under and against the second surface of the other one of the lateral loop segments of the second portion peripheral loop element.

2. The unitary hair clip of claim 1, wherein, in the initial open state, the longitudinal centerline conforms generally to a U shape.

3. The unitary hair clip of claim 1, wherein, in the initial open state, the longitudinal centerline conforms generally to an S shape.

4. The unitary hair clip of claim 3, wherein in the initial open S-shaped position the first distal end of the first strip portion is curved, and in the in-use closed position, with the first portion bent and torqued about the elastic midsection, the first distal end of the first strip portion retains its curved shape from the initial open position.

5. The unitary hair clip of claim 1, wherein the first portion conforms to a first curve from the first distal end to the elastic midsection, and the second portion conforms to a second curve that is substantially an inversion of the first curve from the second distal end to the elastic midsection.

6. The unitary hair clip of claim 1, wherein the first portion is subdivided as a plurality of parallel members.

7. The unitary hair clip of claim 1, wherein the hair clip in the closed position has a generally concave contour to conform generally to a human head.

8. The unitary hair clip of claim 1, further including an internal leaf spring disposed entirely within the elastic midsection.

9. The unitary hair clip of claim 1, wherein the hair clip is operable to move between the open position to the closed position, wherein the hair clip is closed by:

bending the first portion about the elastic midsection towards the second portion;

accentuating the bend of the first portion to place the first distal end through the aperture;

releasing the bend to extend the first distal end through the aperture, the release of the bend further bringing the first surface of the first distal end into pressured contact with the first surface of the second distal end, the pressured contact achieving a frictional force of sufficient magnitude to hold the first distal end against the second distal end; and wherein the hair clip is opened by:

depressing the first portion through the aperture to bend the first portion about the elastic midsection and separate the first distal end from the second distal end;

accentuating the bend of the first portion to place the first distal end within the aperture; and withdrawing the first distal end from the aperture and releasing the first portion.

10. The unitary hair clip of claim 1, wherein the aperture has a length greater than the second width.

11. The unitary hair clip of claim 1, wherein the first distal end is slidable against the second distal end, with the first portion having a length that is long enough that is can be deflected and still bind the hair bundle against the second portion, slide against the second distal end, and maintain binding contact with the second distal end.

12. The unitary hair clip of claim 1, wherein the second surface of the second loop portion includes a plurality of gripping elements disposed peripherally around the aperture.

13. The unitary hair clip of claim 1, wherein a spring element is embedded internally within the elastic midsection.

14. The unitary hair clip of claim 13, wherein the spring element is a plastic spring element.

15. A method of temporarily binding a bundle of hair, the method including:

providing a hair clip comprising a continuous strip of flexible material having a first surface, a second surface, a longitudinal center line, an elastic midsection, a first portion with a first distal end extending along the longitudinal centerline from the elastic midsection and with a first width, a second portion with a second distal end extending along the longitudinal centerline from the elastic midsection opposite to the first portion, the second portion defining an aperture disposed about the longitudinal centerline and between the elastic midsection and the second distal end, the aperture having a second width greater than the first width and a length greater than the second width, the elastic midsection biasing the contiguous flexible strip toward an initial open position and against movement to an in-use closed position, in the open position the first and second portions are separated so that the hair bundle can be inserted therebetween, and in the closed position the first and second portions are coupled together so that the hair bundle is gripped therebetween, the method comprising moving the hair clip from the initial open position to the in-use closed position by:

bending the first portion about the elastic midsection towards the second portion with the hair bundle between the first and second positions;

accentuating the bend of the first portion to place the first distal end through the aperture; and releasing the bend to extend the first distal end along the aperture, the release of the bend further bringing the first surface of the first distal end into pressured contact with the first surface proximate to the second distal end, the pressured contact achieving a frictional force of sufficient magnitude to hold the first distal end against the second distal end with the hair bundle routed under and against the second surface of the second portion, at least partially out through the second portion aperture, over and against the second surface of the first portion, and in through the second portion aperture under and against the second surface of the second portion.

16. The method of claim 15, further comprising moving the hair clip from the closed position back to the open position by:

depressing the first portion through the aperture to bend the first portion about the elastic midsection and separate the first distal end from the second distal end;

accentuating the bend of the first portion to place the first distal end within the aperture;

withdrawing the first distal end from the aperture and releasing the first portion; and removing the hair bundle from between the first and second portions.

17. The method of temporarily binding a bundle of hair of claim 15, wherein the step of providing further includes providing a spring element embedded internally within the elastic midsection.

* * * * *